US011315406B2

(12) United States Patent
Benoit et al.

(10) Patent No.: US 11,315,406 B2
(45) Date of Patent: Apr. 26, 2022

(54) SYSTEMS AND METHODS FOR EMERGENCY EVENT REPORTING AND EMERGENCY NOTIFICATION

(71) Applicants: David B. Benoit, West Hartford, CT (US); Phillip A. Giancarlo, Lebanon, CT (US)

(72) Inventors: David B. Benoit, West Hartford, CT (US); Phillip A. Giancarlo, Lebanon, CT (US)

(73) Assignee: WEARSAFE LABS, LLC, Hartford, CT (US)

( * ) Notice: Subject to any disclaimer, the term of this patent is extended or adjusted under 35 U.S.C. 154(b) by 0 days.

(21) Appl. No.: 16/834,379

(22) Filed: Mar. 30, 2020

(65) Prior Publication Data

US 2021/0043063 A1 Feb. 11, 2021

Related U.S. Application Data

(63) Continuation of application No. 15/784,911, filed on Oct. 16, 2017, now Pat. No. 10,607,473, and a continuation of application No. 15/033,544, filed on Jan. 21, 2016, now Pat. No. 9,813,535, said application No. 15/784,911 is a continuation of application No. 15/003,573, filed on Jan. 21, 2016, now Pat. No. 9,792,807.

(60) Provisional application No. 62/107,205, filed on Jan. 23, 2015, provisional application No. 62/107,212, filed on Jan. 23, 2015.

(51) Int. Cl.
*G08B 25/00* (2006.01)
*G08B 21/02* (2006.01)

(52) U.S. Cl.
CPC ..... *G08B 25/009* (2013.01); *G08B 21/02* (2013.01)

(58) Field of Classification Search
CPC ..... G08B 25/009
See application file for complete search history.

(56) References Cited

U.S. PATENT DOCUMENTS 9,792,807 B2 * 10/2017 Benoit ..... G08B 21/02
2006/0267783 A1 * 11/2006 Smith ..... G01W 1/00 340/601
2007/0262857 A1 * 11/2007 Jackson ..... G06T 7/70 340/506
2009/0002181 A1 * 1/2009 Gayden ..... G08B 7/06 340/601
2009/0325535 A1 * 12/2009 Felt ..... H04W 4/024 455/404.1
2010/0048194 A1 * 2/2010 Park ..... G06F 1/1626 455/418
2010/0107192 A1 * 4/2010 Sennett ..... G08B 27/006 725/33

(Continued)

*Primary Examiner* — Travis R Hunnings
(74) *Attorney, Agent, or Firm* — John M. Behles

(57) ABSTRACT

Systems and methods for emergency event reporting and emergency notification are provided herein. An example method includes monitoring a location of one or more devices of a plurality of devices, selecting an environmental safety condition for the one or more devices using the location, and selecting a device behavior for the one or more devices, the device behavior including a physical response produced by the one or more devices that is based on the environmental safety condition and the location.

12 Claims, 7 Drawing Sheets

(56) References Cited

U.S. PATENT DOCUMENTS

| | | | | |
|---|---|---|---|---|
| 2011/0248863 | A1* | 10/2011 | Johnson | H04L 51/14 340/686.1 |
| 2011/0316698 | A1* | 12/2011 | Palin | H04L 43/04 340/540 |
| 2014/0191873 | A1* | 7/2014 | Kreiner | H04M 1/72418 340/604 |
| 2015/0137972 | A1* | 5/2015 | Nepo | G08B 25/10 340/539.13 |

* cited by examiner

SYSTEMS AND METHODS FOR EMERGENCY EVENT REPORTING AND EMERGENCY NOTIFICATION

CROSS REFERENCE TO RELATED APPLICATIONS

This non-provisional United States patent application claims the benefit and priority of U.S. Provisional Application Ser. No. 62/107,212, filed on Jan. 23, 2015, which is hereby incorporated by reference herein in its entirety, including all references and appendices cited therein.

FIELD OF THE INVENTION

The present disclosure pertains to personal security devices, and more specifically, but not by way of limitation, to devices and systems that enhance the security of a person by using a third party or a user-community pool of safety data that can be used to generate alerts or improve user navigation.

SUMMARY

According to some embodiments, the present disclosure is generally related to a device, comprising: (a) a processor; and (b) a memory for storing logic, the logic being executed by the processor to: (i) select an environmental safety condition for the device based on a physical location of the device; and (ii) select a device behavior for the device, the device behavior comprising a vibration pattern produced by the device that is based on the environmental safety condition.

According to some embodiments, the present disclosure is directed to a method comprising: (a) monitoring a location of one or more devices of a plurality of devices; (b) selecting an environmental safety condition for the one or more devices using the location; and (c) selecting a device behavior for the one or more devices, the device behavior comprising a physical response produced by the one or more devices that is based on the environmental safety condition and the location.

According to some embodiments, the present disclosure is directed to a method, comprising (a) selecting an environmental safety condition for the device based on a physical location of the device; and (b) selecting a device behavior for the device, the device behavior comprising a vibration pattern produced by the device that is based on the environmental safety condition.

A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions. One general aspect includes a device, including: a processor; and a memory for storing logic, the logic being executed by the processor to select an environmental safety condition for the device based on a physical location of the device. The device also selects a device behavior for the device, the device behavior including a vibration pattern produced by the device that is based on the environmental safety condition. Other embodiments of this aspect include corresponding computer systems, apparatus, and computer programs recorded on one or more computer storage devices, each configured to perform the actions of the methods.

Embodiments may include one or more of the following features. A device where the vibration pattern includes a first vibration pattern when the environmental safety condition is a first environmental safety condition and the vibration pattern includes a second vibration pattern when the environmental safety condition is a second environmental safety condition, the first environmental safety condition being different from the second environmental safety condition.

A device where the logic is further executed by the processor to: receive an indication that an emergency event has occurred; and capture image or video content during the emergency event.

A device where the logic is further executed by the processor to: record the physical location and a time of the emergency event.

A device where the logic is further executed by the processor to: determine if the device belongs to a user pool; and store the image or video content captured by the device for the user pool. A device where the user pool is based upon at least one pool attribute.

A device where the logic is further executed by the processor to transmit an anonymized report to a repository that is descriptive of an emergency event occurring in the physical location. A device where the logic is further executed by the processor to: receive a pattern of user input into an input mechanism of the device; and place the device into an operational mode based on the pattern. A device where the logic is further executed by the processor to: receive a pattern of user input into an input mechanism of the device; and define the environmental safety condition based on the pattern of user input. A device where the logic is further executed by the processor to place the device into an operational mode based on the pattern of user input.

A device where the logic is further executed by the processor to: track the physical location of the device; and where the environmental safety condition is selectively adjusted based on a change in the physical location. A device where the logic is further executed by the processor to generate a warning message when the device enters the physical location and the physical location corresponds to a restricted virtual geo-fenced area.

The method further including receiving from at least a portion of the plurality of devices, anonymized reports of emergency incidents, where each of the emergency incidents includes a location; grouping the anonymized reports into groups based on any of: the location or device attributes or user attributes (e.g., family, friends, employees, co-workers, residents, ad hoc created groups, and so forth). The method may also include user pools defined by portions of the plurality of devices that are related to one another by at least one pool attribute. The method further including continually reviewing the anonymized reports from the plurality of devices, and based on the continual review: The method may also include re-selecting the environmental safety condition for at least one of the one or more devices. The method may also include re-selecting the device behavior for the at least one of the one or more devices, the device behavior including a vibration pattern produced by the device that is based on the environmental safety condition.

In some embodiments, the reports and/or data included therein need not be anonymized. Some embodiments allow a user to select whether anonymization is used or not.

The method may further include generating directions or instructions that direct a user of the one or more devices along a path that avoids dangerous locations within a location that includes the environmental safety condition.

An example method includes receiving a destination for at least one device of the plurality of devices. The method may also include outputting a warning message to the at least one devices that includes an alternative destination that avoids the environmental safety condition. In other embodiments, the warning message comprises audible tone(s), vibrations, screen or light flashes (when the device includes a light source or screen), and any combinations or permutations thereof.

An example method includes transmitting an alert message to one or more trusted contacts when the one or more devices enters a location that includes the environmental safety condition, and the environmental safety condition that is indicative of danger. A method can also utilize an environmental safety condition that includes any of a weather event, an area of high crime as indicated by anonymized reports from the plurality of devices, a high crime area, a dangerous intersection, a combination of weather and topographical information, or combinations thereof. Implementations of the described techniques may include hardware, a method or process, or computer software on a computer-accessible medium.

Implementations may include one or more of the following features. The method further including receiving from at least a portion of the plurality of devices, anonymized reports of emergency incidents, where each of the emergency incidents includes a location; grouping the anonymized reports into groups based on any of: the location. The method may also include user pools defined by portions of the plurality of devices that are related to one another by at least one pool attribute.

A method includes continually reviewing the anonymized reports from the plurality of devices, and based on the continual review. The method may also include re-selecting the environmental safety condition for at least one of the one or more devices. The method may also include re-selecting the device behavior for the at least one of the one or more devices, the device behavior including a vibration pattern produced by the device that is based on the environmental safety condition.

The method including generating directions or instructions that direct a user of the one or more devices along a path that avoids dangerous locations within a location that includes the environmental safety condition. The method including receiving: a destination for at least one device of the plurality of devices. The method may also include outputting a warning message to the at least one devices that includes an alternative destination that avoids the environmental safety condition.

A method including transmitting an alert message to one or more trusted contacts when the one or more devices enters a location that includes the environmental safety condition, and the environmental safety condition that is indicative of danger.

A method where the environmental safety condition includes any of a weather event, an area of high crime as indicated by anonymized reports from the plurality of devices, a high crime area, a dangerous intersection, a combination of weather and topographical information, or combinations thereof.

BRIEF DESCRIPTION OF THE DRAWINGS

The accompanying drawings, where like reference numerals refer to identical or functionally similar elements throughout the separate views, together with the detailed description below, are incorporated in and form part of the specification, and serve to further illustrate embodiments of concepts that include the claimed disclosure, and explain various principles and advantages of those embodiments.

The methods and systems disclosed herein have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION

Figure 1:
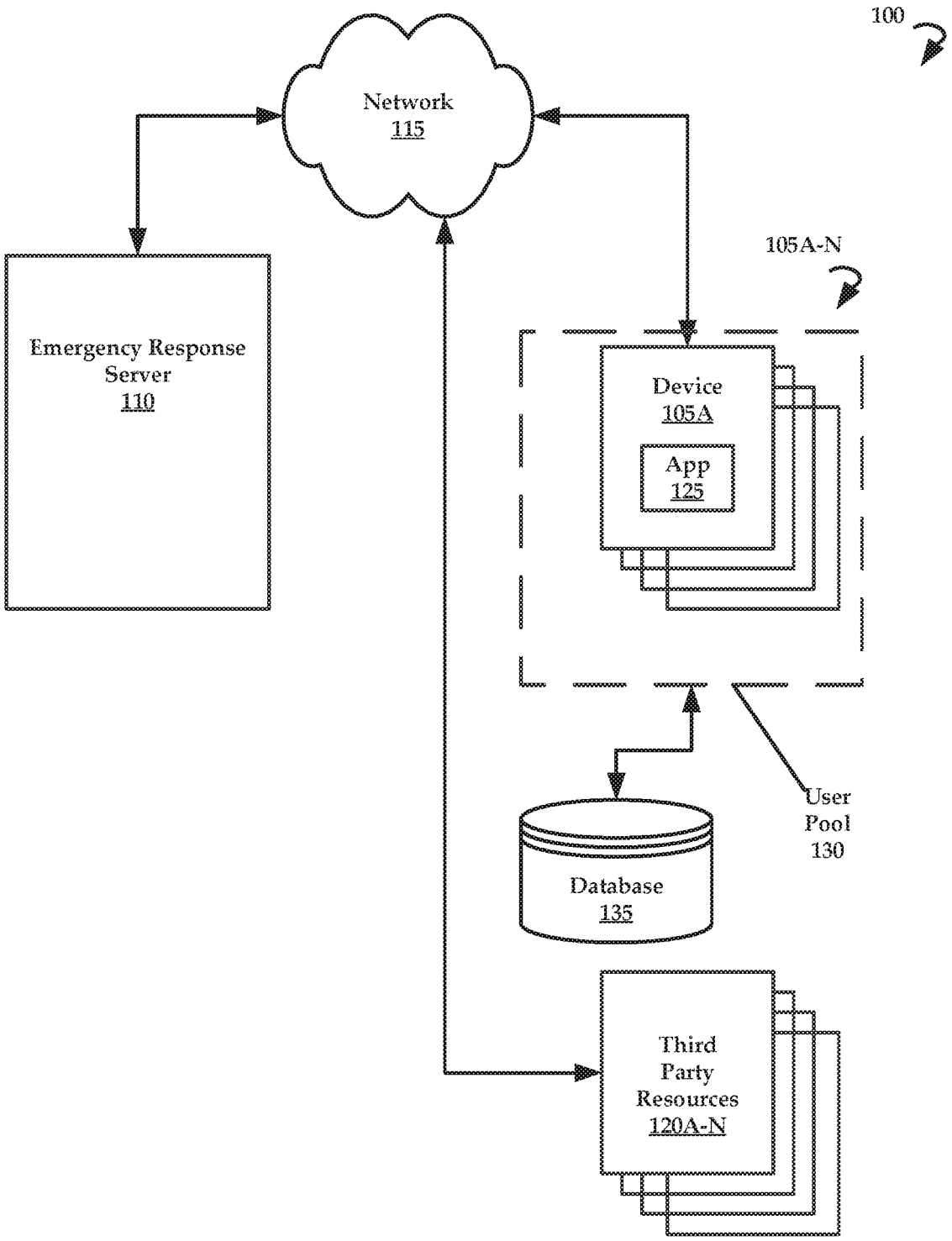
FIG. 1 is a schematic diagram of an example system of the present disclosure.

The present disclosure is now described more fully with reference to the accompanying drawings, in which example embodiments of the present disclosure are shown. The present disclosure may, however, be embodied in many different forms and should not be construed as necessarily being limited to the example embodiments set forth herein. Rather, these example embodiments are provided so that the disclosure is thorough and complete, and fully conveys the concepts of the present disclosure to those skilled in the art. Also, features described with respect to certain example embodiments may be combined in and/or with various other example embodiments. Different aspects and/or elements of example embodiments, as disclosed herein, may be combined in a similar manner. Further, at least some example embodiments may individually and/or collectively be components of a larger system, wherein other procedures may take precedence over and/or otherwise modify their application. Additionally, a number of steps may be required before, after, and/or concurrently with example embodiments, as disclosed herein. Note that any and/or all methods and/or processes, at least as disclosed herein, can be at least partially performed via at least one entity, at least as described herein, in any manner, irrespective of the at least one entity have any relationship to the subject matter of the present disclosure.

Generally described, the present disclosure provides enhanced safety features for mobile users by comparing location information for the mobile device with location-based safety information gathered from a third party resource such as a police crime reports, crime statistics, government statistical data, and so forth. In addition to, or in place of third party safety data, the present disclosure can use safety data obtained from a user community to which the mobile user belongs. For example, the user of the mobile device belongs to a group of users of the same type or mobile device, such as an emergency alert activator.

The group that the user belongs to may be created by various means. For example, the provider of the mobile device may track and store location-based safety information, such as user activations of their emergency alert activator, noting that an emergency event has occurred. These events can be tracked and stored in a database. For each emergency event, a location and time is obtained, as well as any emergency event related information.

The group could also be created to include a plurality of users that are grouped together according to a condition or attribute. For example, users that live in a specific neighborhood, city, or other common geographical location can benefit from targeted safety information that is tailored to their desired location, rather than deduced or inferred from general statistical data.

Furthermore, flaws with general government statistical information can impact the usability of some types of data. For example, incomplete reporting of crime to government agencies can occur when emergency events are not reported or are underreported to authorities. The use of an anonymous, semi-anonymous group pool of mobile users for reporting emergency events can overcome this hesitancy to report emergency events. In some embodiments, the users are not anonymous, but no safety data is accessible or provided to any third party such that users can share their data in confidence. Anonymizing can include removing names, device identifiers, personally identifiable information, device identifying information, or any other information that is not necessary for linking the report comprising the emergency event data with a location.

The emergency event data described herein can generally be any emergency related information that indicates an emergency event against a person or persons that has occurred or may occur. For example, a user witnesses a robbery of a vehicle or a person. The location and time of the crime are recorded by determining the location of the mobile device of the user.

In another example, numerous users report traffic accidents at the same highway interchange. These accidents are due to poorly placed signage or possibly confusing traffic cone placement. These traffic incidents indicate an area where a user would likely avoid if the emergency events were known. These types of safety hazards can be avoided with the use of the present disclosure.

The user can report these crimes or accidents to the database. In another example, a user reports that they have been involved in a traffic accident. Again, location and time information are obtained.

In yet another example, a user overhears a threatening conversation occurring at a convenience store between two other parties. The user can report this behavior. The user can also report drug deals, assaults, shootings, or other emergency events that have a tendency not to be reported by participating parties.

In addition to capturing emergency data that would otherwise go underreported or unreported, the present disclosure also provides more immediate access to emergency data compared to compiled crime statistics or government data.

Turning to FIG. 1, an example system 100 is illustrated. The system 100 comprises a plurality of devices 105A-N that include end user computing devices such as laptops, Smartphones, tablets and so forth. The plurality of devices 105A-N are each configured to interact with an emergency response server (server 110).

The server 110 may communicatively couple with the plurality of devices 105A-N via a public or private network 115. Suitable networks may include or interface with any one or more of, for instance, a local intranet, a PAN (Personal Area Network), a LAN (Local Area Network), a WAN (Wide Area Network), a MAN (Metropolitan Area Network), a virtual private network (VPN), a storage area network (SAN), a frame relay connection, an Advanced Intelligent Network (AIN) connection, a synchronous optical network (SONET) connection, a digital T1, T3, E1 or E3 line, Digital Data Service (DDS) connection, DSL (Digital Subscriber Line) connection, an Ethernet connection, an ISDN (Integrated Services Digital Network) line, a dial-up port such as a V.90, V.34 or V.34bis analog modem connection, a cable modem, an ATM (Asynchronous Transfer Mode) connection, or an FDDI (Fiber Distributed Data Interface) or CDDI (Copper Distributed Data Interface) connection. Furthermore, communications may also include links to any of a variety of wireless networks, including WAP (Wireless Application Protocol), GPRS (General Packet Radio Service), GSM (Global System for Mobile Communication), CDMA (Code Division Multiple Access) or TDMA (Time Division Multiple Access), cellular phone networks, GPS (Global Positioning System), CDPD (cellular digital packet data), RIM (Research in Motion, Limited) duplex paging network, Bluetooth radio, or an IEEE 802.11-based radio frequency network. The network 115 can further include or interface with any one or more of an RS-232 serial connection, an IEEE-1394 (Firewire) connection, a Fiber Channel connection, an IrDA (infrared) port, a SCSI (Small Computer Systems Interface) connection, a USB (Universal Serial Bus) connection or other wired or wireless, digital or analog interface or connection, mesh or Digi® networking.

In some embodiments, the plurality of devices 105A-N and/or the server 110 can access and utilize various third party resources or databases 120A-N such as weather information, crime data, government data and statistics, as well as other databases or information resources that provide information about geographical locations. This collective of information can be used to generate environmental safety conditions that correspond to geographical locations. In some embodiments, many environmental safety conditions can exist for a geographical location, such as weather warnings, traffic issues, crime statistics, and so forth. The system 100 can leverage a plurality of resources in some embodiments to provide the users of the devices 105A-N with numerous types of warnings, as described herein.

In general, an environmental safety condition comprises parameters or attributes (e.g., content) corresponding to a location that are indicative of weather warnings, traffic issues, crime statistics, and other generalized information about the location. The environmental safety condition can also include user specified, subjective content that is uploaded to the system 100 by users in the location, or users that have provided feedback or content about the area. This can include users that can be verified as having been at the location at some point in time, by reviewing device logs.

In some embodiments, devices and systems of the present disclosure can alert a user that they have entered a questionable crime area by sending an alert message to a mobile device of the user. In some embodiments, the devices 105A-N execute an application "App 125" as with device 105A, that is configured to track the movement of the mobile device and compare the device 105A location to location-based safety information from the third party resources 120A-N. The device 105A can obtain the safety information from the server 110 that is in turn connected to the third party resources 120A-N.

In other embodiments, the device 105A can receive environmental safety condition messages from a user pool 130. The user pool 130 can provide current information regarding the user's location that is near-real time, rather than selected or queried from third party resources 120A-N. In some embodiments, the server maintains the user pool of safety information collected from the user pool.

The App 125 can initially determine if the device belongs to a user pool or group of other devices that are linked by an attribute. If the device 105A does belong to a user pool the user is provided with an option to store the image or video content captured by the device for the user pool. In some embodiments, the images or video are received during emergency events, but the user pool can store text, images, and/or video from pool users for any reason so as to create a robust library of location specific content.

In one embodiment, safety information is collected from users that utilize the App 125 or that subscribe to a safety reporting service provided by the server 110.

A user can specify which safety events they are interested in being alerted about, such as possible violent crime or traffic issues. For example, the user may wish to avoid known dangerous intersections. The App 125 can provide the user with turn-by-turn directions that guide the user away from the dangerous intersections. Information regarding whether an intersection is dangerous or not can be determined from (1) historical traffic data obtained from third party resources 120A-N; (2) real time traffic information gathered from the user pool 130 (an example could include nearby devices that are sending SMS messages that indicate that a wreck has occurred); (3) various combinations of (1) and (2).

In some embodiments, the App 125 can be configured to provide directions and alerts related to hazards, weather, terrain, and so forth. In one example, the App 125 can utilize topographical information as well as weather-related information from third party resources to avoid hazards or combinations of hazards such as flooding, heavy rain, and so forth. In another example, topographical information such as a hill gradients are used in combination with weather information to determine that a steep hill in the general location of the device 105A should be avoided because there is ice in the immediate area. The App 125 can suggest alternative routes that allow the user of the device 105A to avoid the dangerous hill.

According to some embodiments, in addition to providing emergency alert communications, the App 125 can also be configured to provide a secondary or additional type of supplemental informational content to the user. This supplemental informational content could include safety tips that are tailored to the types of hazards or emergency events in the area. For example, if the App 125 determines that the user is in a potentially unsafe area with respect to a weather event such as hail, the App 125 can provide the user with walking directions to a protected public space. In another example, if the App 125 determines that the user is in a parking lot where robberies have occurred, the App 125 can provide the user with a list of tips that will help the user stay alert and aware of potential hazards. For example, the tips could include the user having their keys ready, rather than in a purse or pocket. Another tip could instruct the user to look around their vehicle for suspicious activity prior to approaching the vehicle, or possibly calling for a security guard to walk them to their vehicle. Another tip could include (if available), using their remote to turn on the interior lights of the car. Again, these are merely examples of possible tips that can be provided.

Emergency alerts can be provided through the App 125 to a user of the device 105A or can also be provided to the user through email or SMS messages to an email client or the device 105A. It will be understood that other messaging procedures can also likewise be utilized such as push notifications, MMS, and so forth.

In addition (or alternatively) to providing an alert to the user, the App 125 is configured to transmit alert messages to parties in a trusted contact list for the user. In one example, if the user enters an unsecure area, the App 125 immediately notifies one or more of the parties on the trusted contact list.

For example, the device 105A enters a physical location that is determined to be a high crime area based on information gathered from the third party resources 120A-N. The App 125 can send alert messages from the device 105A to devices included in the trusted contact list.

In another embodiment, the App 125 or server 110 can examine user pool 130 data and determine that an armed robbery is occurring within two blocks of the device 105A. The App 125 can alert the user to avoid the area around the armed robbery. Information gathered from the user pool 130 can be augmented using information gathered from police scanners and other real-time or current data reporting sources, such as social networks.

Figure 2:
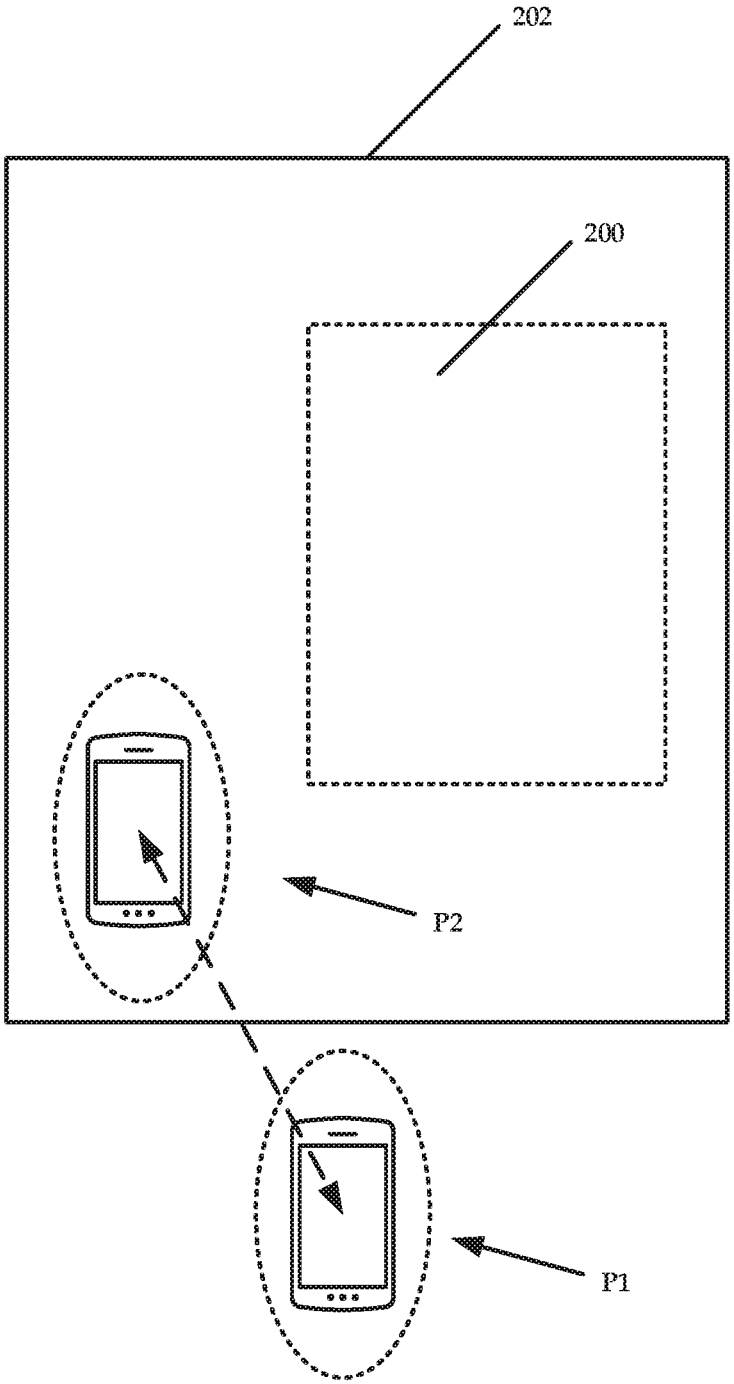
FIG. 2 is a schematic diagram of an example virtual geo-fence utilized to enclose or define a portion or all of a physical location, as well as the movement of a device in proximity to the virtual geo-fence.

As illustrated in FIG. 2, according to some embodiments another party such as a parent, guardian or other similar party can create a virtual geo-fence 200 that comprises a boundary 202 that encompasses a physical geographical location. By way of example, a geo-fence could encompass a certain area in a neighborhood. The geo-fence can be defined in terms of latitude and longitude points that are connectable together. The parent can utilize a mapping function to draw or create the geo-fence.

When the device 105A approaches the virtual geo-fence 200, the user is provided with a warning. When the device 105A breaches the virtual geo-fence 200, a warning message is transmitted to the parent or another third party by the App 125.

It will be understood that the server 110 can be configured to provide one or more of the functionalities described above with respect to the device 105A. Thus, the device 105A does not require the App 125 in some embodiments. The server 110 functions as a proxy between the device 105A and the third party resources 120A-N or the user pool 130.

Figure 3:
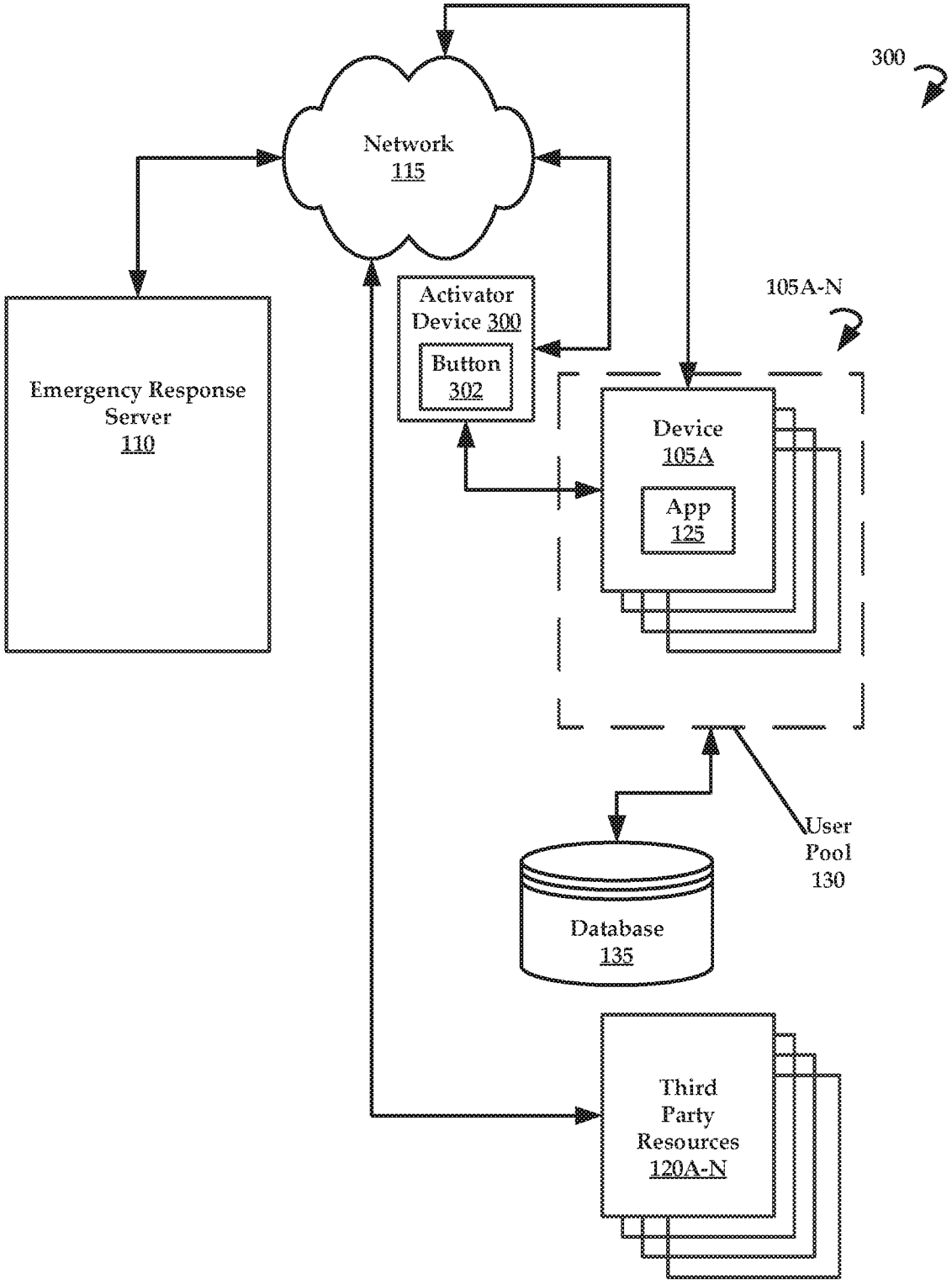
FIG. 3 is a schematic diagram of another example system of the present disclosure.

Turning to FIG. 3, another example system is illustrated, which is similar to the system of FIG. 1 with the exception that an emergency activator 300 can be used in combination with the device 105A.

In some embodiments, the user may desire to obtain safety alerts in an inconspicuous manner using the activator device 300. To be sure, the user can also report or indicate the occurrence of an emergency event by using the activator. The user need only depress an activator button 302 to record occurrence of the event. For example, the user depresses activator button 302, which triggers recording to occur on the device 105A.

The user can report the details of the event at a later time when it is safe. Thus, the user can inconspicuously report an event without making a telephone call, sending a text message, or using their mobile device, which may draw unwanted attention to the user.

In some embodiments, the user can use a pattern of button depressions to indicate a type of event or the user's perception of risk. For example, the user can depress the activator button a set number of times to indicate that the user feels uncomfortable or vulnerable, and a different number of times to indicate that an assault has taken place or that they have been abducted.

The server 110 or device 105A can also be configured to alert the user of a possible emergency situation or a dangerous area by causing a pattern of vibrations on the activator device 300. The user can inconspicuously receive alerts and make changes in their travel or immediate location without drawing attention.

In one embodiment, the activator device 300 or device 105A can select a device behavior. In one embodiment, the device behavior comprises a vibration pattern produced by the activator device 300 or device 105A that is based on the environmental safety condition. The device behavior can also (or alternatively) include turning on a camera to capture images and/or video, emitting sound from a speaker of the device 105A.

For example, the user is walking to a desired location in a city in which they are unfamiliar, which can occur when the user is on vacation or a business trip. The activator device 300 or device 105A can sense the location of the user and consult the user pool database as well as the third party resources. If a determination is made that the user is in a location that is unsafe the server 110 or device 105A can engage the activator device 300 to vibrate and indicate a possible emergency situation or unsafe location.

The environmental safety condition can be dynamic in nature, such that the environmental safety condition selected for the activator device 300 or device 105A and the device behavior change as the activator device 300 or device 105A changes location.

For example, in some embodiments, a vibration pattern comprises a first vibration pattern, such as alternating short and long vibrations. This pattern is selected when a traffic accident is near. The traffic accident would be a first type of environmental safety condition. Assuming the driver diverts around the traffic issue and the driver continues on to their destination. Along their travel route, a second environmental safety condition is selected for the device because the device is entering an area where a flash flood is occurring. The App 125 selects a second vibration pattern. That comprises a series of short vibrations and a chirp that is emitted from the activator device 300 or device 105A.

To be sure, the device behavior selected is based on the location and specific environmental safety conditions in the respective locations.

In some embodiments, an alert can be sent to the activator device 300 or device 105A from the server as well, such as an informational message. In the example above, the flash flood event could include an SMS message from the National Weather Service.

As mentioned above, the emergency event data can include not only location data but also date and time information. The App 125 can time stamp environmental safety conditions selected by the App 125. Historical patterns of emergency data can be determined and various reports generated.

Also, the location and time of an emergency event report by a user can determine the emergency alert type that is provided back to the user. For example, the server 110 or device 105A determines that the user is in a parking lot of a mall at 10 pm at night (from location and time information provided by the activator device 300 or device 105A), which is two hours after the closing of the mall. It is determined from the user pool 130 that several assaults have occurred in the general area in the last two months. An emergency alert is sent to the activator device 300 and/or device 105A in the form of several long vibrations. This type of alert informs the user to keep a close eye out for suspicious activity, but does not distract the user by the transmission of an email or SMS, which causes the user to be distracted by viewing the alert.

The type of emergency alert that is sent to the user at this time and location is different from the alert that is sent in response to determining that the user has requested walking directions to a store that is determined to be in a high crime area. An SMS message or email can be transmitted to the device 105A by the server 110. Again, it will be understood that other messaging procedures can also likewise be utilized such as push notifications, MMS, and so forth. Also, the App on the device 105A can provide the user with other alternative stores that are within walking distance or in a safer area.

In some embodiments, the activator device 300 and/or device 105A can be utilized to define an emergency event and/or environmental safety condition based on a pattern of user input. For example, a user can depress the activator button 302 of the activator device 300 a set number of times to indicate, for example, an assault. The App 125 or server 110 receives this series of inputs and selects an environmental safety condition for the device 105A, such as turning on the camera of the device 105A and/or placing the device in stealth mode.

The App 125 or server 110 then time stamps the emergency event and determines a location of the user from the device 105A. The App 125 or server 110 can then transmit alert messages to other App users in the same location and select an environmental safety condition for these additional devices (e.g., user pool).

In some embodiments, the App 125 can place the device 105A in an operational mode based on the user input. For example, if the user holds the activator button 302 for a period of time and then follows that up with two short inputs, the App 125 can place the device 105A in a stealth mode of operation, where the display of the device is locked but the camera and microphone are in record mode.

According to some embodiments, in addition to the emergency alerts provided to the user, the present disclosure can be used for commercial purposes such as provision of targeted advertising for products or services. In some embodiments, the targeting of the advertisements is linked to the geographical area and/or possible hazard or emergency events in the area. For example, if the user is walking by a department store the App can distribute advertisements to the user for that particular store. In some embodiments, the advertisements are further targeted or tailored based on information known about possible hazards that the user may encounter. If the user is walking from home to work, the App can suggest that the user stop in at a department store to purchase an umbrella or coat if the user is likely to encounter rain on their walk home.

Figure 4:
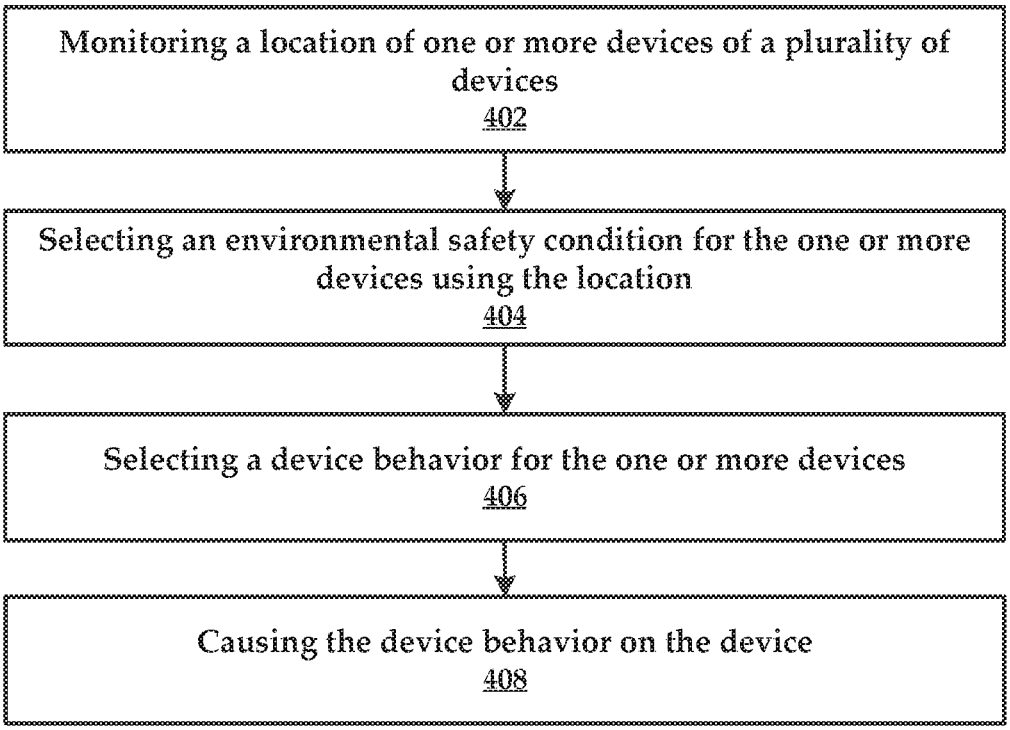
FIG. 4 is a flowchart of an example method of the present disclosure.

FIG. 4 is a flowchart of an example method that can be performed in accordance with the present disclosure. The method can include a step of monitoring 402 a location of one or more devices of a plurality of devices. The plurality of devices can be considered a user pool based on the fact that they are in a certain location, such as a city, although the location can be much more granular, such a city block or street, or even a perimeter around a set of location coordinates.

The method can also include a step 404 of selecting an environmental safety condition for the one or more devices using the location. For example, an environmental safety condition can be selected for a subset of devices near a dangerous weather event, such as a flooding street.

Next, the method includes selecting 406 a device behavior for the one or more devices. As mentioned above, the device behavior can comprise a physical response produced by the one or more devices that is based on the environmental safety condition and the location. For example, the device can vibrate to notify the user that a flood is proximate. A message can also be sent to the device to augment the vibration pattern. In some embodiments, the device can prompt the user by opening their camera and suggesting the user capture a picture of their location, or provide an audio message that is a recording of their view of the location. This information assists in building a real time user pool of information that can be used to confirm or deny the existence of the environmental safety condition. This reduces false positive environmental safety condition messages. The App or server can use the real time reports as a feedback loop, canceling the distribution of the alerts and device behavior settings, if the user feedback indicates that the environmental safety condition is not real.

The method can then include the App or hardware on the device causing the selected device behavior on the device in step 408.

Figure 5:
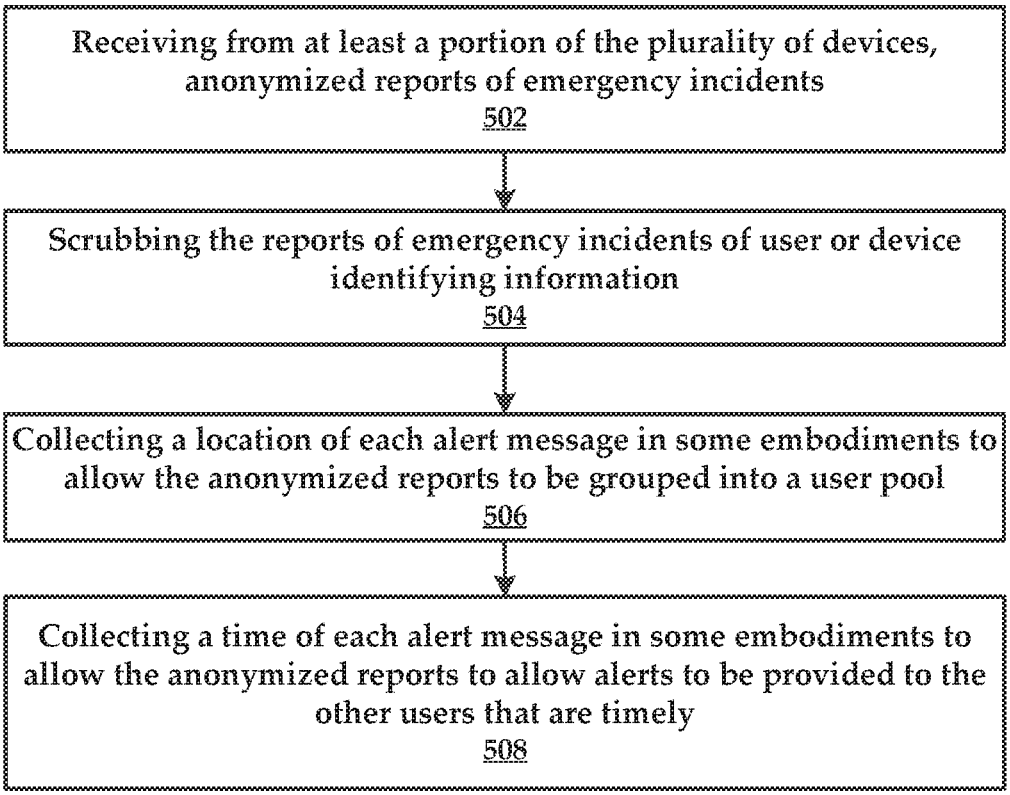
FIG. 5 is a flowchart of another example method of the present disclosure.

FIG. 5 is a flowchart of a sub-method that can be utilized in conjunction with the method of FIG. 4. This method involves the use of anonymized reporting that can help build effective databases and more time sensitive content.

The method can comprise receiving 502 from at least a portion of the plurality of devices, anonymized reports of emergency incidents. For example, the user can use input actions on their device to indicate an emergency type or the user can text an alert message out to the system or provide the message in a user interface provided by the App on their device. The messages can include text, video and/or audio.

In some embodiments, the method includes scrubbing 504 the reports of emergency incidents of user or device identifying information. The method also includes collecting 506 a location of each alert message in some embodiments to allow the anonymized reports to be grouped into a user pool.

In one embodiment, the method includes collecting 508 a time of each alert message in some embodiments to allow the anonymized reports to allow alerts to be provided to the other users that are timely. For example, alerts that are hours or days old may not be relevant to users.

Figure 6:
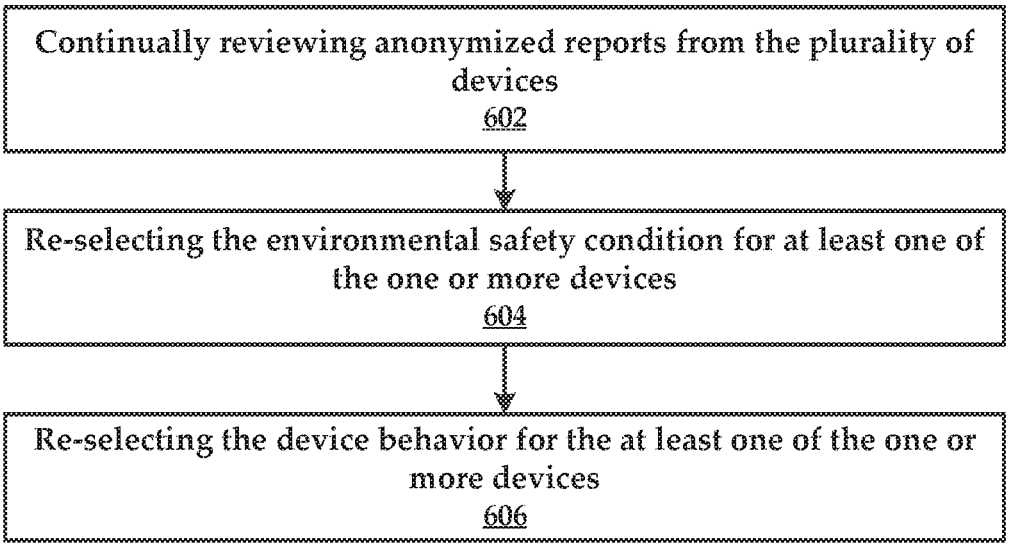
FIG. 6 is a flowchart of yet another example method of the present disclosure.

FIG. 6 is a flowchart of a sub-method that can be utilized in conjunction with the method of FIG. 4 and/or FIG. 5. The method involves the use of anonymized reports to create feedback loops that are used to update the selection of environmental safety conditions and/or device behaviors.

The method is a continual or periodic process that includes, in some embodiments, continually reviewing 602 anonymized reports from the plurality of devices, and based on the continual review, re-selecting 604 the environmental safety condition for at least one of the one or more devices. For example, a first emergency safety condition can be set to indicate that a fire is happening in a building. The system or devices can inform users in the building to get out of the building.

If the users report back that a fire is indeed happening, the images, text or videos gathered from tenants in the building may indicate that several streets have been blocked off by first responders. Thus, the system or devices can output messages to devices around the building that the streets around this building have been shut down and to seek an alternative route. The device can, in some embodiments, provide users with alternative routes that take the user away from the area of concern.

The users can then report that the fire is contained and that the building is back open. Thus, the system can receive these reports and re-select the emergency safety condition to another level, such as caution or clear.

In some embodiments, the method can include re-selecting 606 the device behavior for the at least one of the one or more devices. Using the example above, the device can receive a re-selected device behavior when the reports indicate that the fire is contained and the building is open. The device may output an all clear signal or a series of vibrations that are indicative of an all clear signals (or combinations thereof).

As used herein, the term "engine", "system", "client", "module", "controller", or "application/App" may also refer to any of an application-specific integrated circuit ("ASIC"), an electronic circuit, a processor (shared, dedicated, or group) that executes one or more software or firmware programs, a combinational logic circuit, and/or other suitable components that provide the described functionality.

Figure 7:
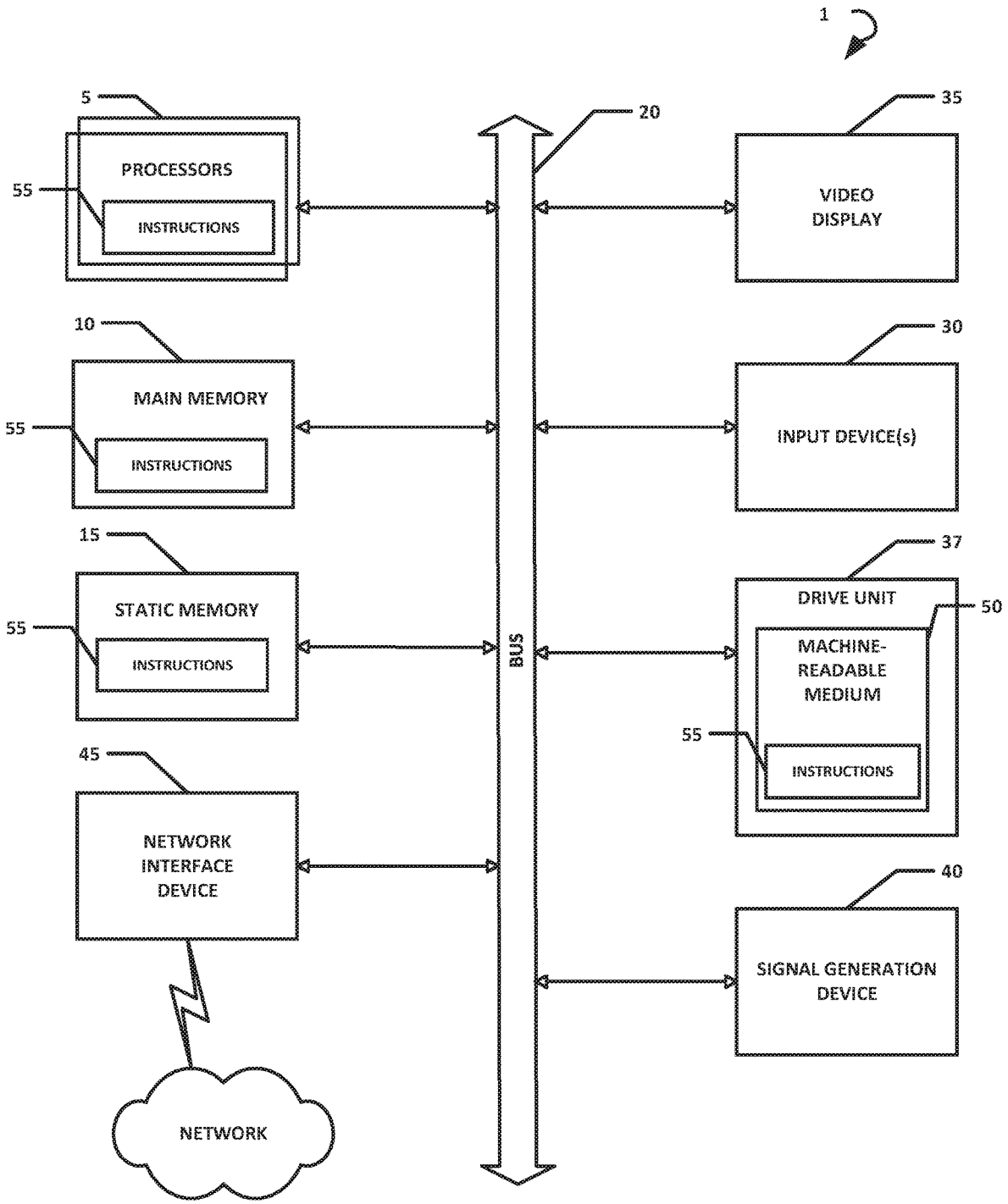
FIG. 7 illustrates an exemplary computing system that may be used to implement embodiments according to the present disclosure.

FIG. 7 diagrammatic representation of an example machine in the form of a computing system 1, within which a set of instructions for causing the machine to perform any one or more of the methodologies discussed herein may be executed. The system 1 of FIG. 7 may be implemented in the contexts of the likes of the activator device, the mobile device, and/or the server described herein.

In various example embodiments, the machine operates as a standalone device or may be connected (e.g., networked) to other machines. In a networked deployment, the machine may operate in the capacity of a server or a client machine in a server-client network environment, or as a peer machine in a peer-to-peer (or distributed) network environment. The machine may be a personal computer (PC), a tablet PC, a set-top box (STB), a personal digital assistant (PDA), a cellular telephone, a portable music player (e.g., a portable hard drive audio device such as an Moving Picture Experts Group Audio Layer 3 (MP3) player), a web appliance, a network router, switch or bridge, or any machine capable of executing a set of instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein.

The example computing system 1 includes a processor or multiple processors 5 (e.g., a central processing unit (CPU), a graphics processing unit (GPU), or both), and a main memory 10 and static memory 15, which communicate with each other via a bus 20. The computing system 1 may further include a video display 35 (e.g., a liquid crystal display (LCD)). The computing system 1 may also include an alpha-numeric input device(s) 30 (e.g., a keyboard), a cursor control device (e.g., a mouse), a voice recognition or biometric verification unit (not shown), a drive unit 37 (also referred to as disk drive unit), a signal generation device 40 (e.g., a speaker), and a network interface device 45. The computing system 1 may further include a data encryption module (not shown) to encrypt data.

The disk drive unit 37 includes a computer or machine-readable medium 50 on which is stored one or more sets of instructions and data structures (e.g., instructions 55) embodying or utilizing any one or more of the methodologies or functions described herein. The instructions 55 may also reside, completely or at least partially, within the main memory 10 and/or within the processors 5 during execution thereof by the computing system 1. The main memory 10 and the processors 5 may also constitute machine-readable media.

The instructions 55 may further be transmitted or received over a network via the network interface device 45 utilizing any one of a number of well-known transfer protocols (e.g., Hyper Text Transfer Protocol (HTTP)). While the machine-readable medium 50 is shown in an example embodiment to be a single medium, the term "computer-readable medium" should be taken to include a single medium or multiple media (e.g., a centralized or distributed database and/or associated caches and servers) that store the one or more sets of instructions. The term "computer-readable medium" shall also be taken to include any medium that is capable of storing, encoding, or carrying a set of instructions for execution by the machine and that causes the machine to perform any one or more of the methodologies of the present application, or that is capable of storing, encoding, or carrying data structures utilized by or associated with such a set of instructions. The term "computer-readable medium" shall accordingly be taken to include, but not be limited to, solid-state memories, optical and magnetic media, and carrier wave signals. Such media may also include, without limitation, hard disks, floppy disks, flash memory cards, digital video disks, random access memory (RAM), read only memory (ROM), and the like. The example embodiments described herein may be implemented in an operating environment comprising software installed on a computer, in hardware, or in a combination of software and hardware.

One skilled in the art will recognize that the Internet service may be configured to provide Internet access to one or more computing systems that are coupled to the Internet service, and that the computing systems may include one or more processors, buses, memory devices, display devices, input/output devices, and the like. Furthermore, those skilled in the art may appreciate that the Internet service may be coupled to one or more databases, repositories, servers, and the like, which may be utilized in order to implement any of the embodiments of the disclosure as described herein.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the present disclosure in the form disclosed. Many modifications and variations will be apparent to those of ordinary skill in the art without departing from the scope and spirit of the present disclosure. Exemplary embodiments were chosen and described in order to best explain the principles of the present disclosure and its practical application, and to enable others of ordinary skill in the art to understand the present disclosure for various embodiments with various modifications as are suited to the particular use contemplated.

Aspects of the present disclosure are described above with reference to flowchart illustrations and/or block diagrams of methods, apparatus (systems) and computer program products according to embodiments of the present disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function (s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

In the following description, for purposes of explanation and not limitation, specific details are set forth, such as particular embodiments, procedures, techniques, etc. in order to provide a thorough understanding of the present invention. However, it will be apparent to one skilled in the art that the present invention may be practiced in other embodiments that depart from these specific details.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" or "according to one embodiment" (or other phrases having similar import) at various places throughout this specification are not necessarily all referring to the same embodiment. Furthermore, the particular features, structures, or characteristics may be combined in any suitable manner in one or more embodiments. Furthermore, depending on the context of discussion herein, a singular term may include its plural forms and a plural term may include its singular form. Similarly, a hyphenated term (e.g., "on-demand") may be occasionally interchangeably used with its non-hyphenated version (e.g., "on demand"), a capitalized entry (e.g., "Software") may be interchangeably used with its non-capitalized version (e.g., "software"), a plural term may be indicated with or without an apostrophe (e.g., PE's or PEs), and an italicized term (e.g., "N+1") may be interchangeably used with its non-italicized version (e.g., "N+1"). Such occasional interchangeable uses shall not be considered inconsistent with each other.

Also, some embodiments may be described in terms of "means for" performing a task or set of tasks. It will be understood that a "means for" may be expressed herein in terms of a structure, such as a processor, a memory, an I/O device such as a camera, or combinations thereof. Alternatively, the "means for" may include an algorithm that is descriptive of a function or method step, while in yet other embodiments the "means for" is expressed in terms of a mathematical formula, prose, or as a flow chart or signal diagram.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It is noted at the outset that the terms "coupled," "connected", "connecting," "electrically connected," etc., are used interchangeably herein to generally refer to the condition of being electrically/electronically connected. Similarly, a first entity is considered to be in "communication" with a second entity (or entities) when the first entity electrically sends and/or receives (whether through wireline or wireless means) information signals (whether containing data information or non-data/control information) to the second entity regardless of the type (analog or digital) of those signals. It is further noted that various figures (including component diagrams) shown and discussed herein are for illustrative purpose only, and are not drawn to scale.

If any disclosures are incorporated herein by reference and such incorporated disclosures conflict in part and/or in whole with the present disclosure, then to the extent of conflict, and/or broader disclosure, and/or broader definition of terms, the present disclosure controls. If such incorporated disclosures conflict in part and/or in whole with one another, then to the extent of conflict, the later-dated disclosure controls.

The terminology used herein can imply direct or indirect, full or partial, temporary or permanent, immediate or delayed, synchronous or asynchronous, action or inaction. For example, when an element is referred to as being "on," "connected" or "coupled" to another element, then the element can be directly on, connected or coupled to the other element and/or intervening elements may be present, including indirect and/or direct variants. In contrast, when an element is referred to as being "directly connected" or "directly coupled" to another element, there are no intervening elements present.

Although the terms first, second, etc. may be used herein to describe various elements, components, regions, layers and/or sections, these elements, components, regions, layers and/or sections should not necessarily be limited by such terms. These terms are only used to distinguish one element, component, region, layer or section from another element, component, region, layer or section. Thus, a first element, component, region, layer or section discussed below could be termed a second element, component, region, layer or section without departing from the teachings of the present disclosure.

Example embodiments of the present disclosure are described herein with reference to illustrations of idealized embodiments (and intermediate structures) of the present disclosure. As such, variations from the shapes of the illustrations as a result, for example, of manufacturing techniques and/or tolerances, are to be expected. Thus, the example embodiments of the present disclosure should not be construed as necessarily limited to the particular shapes of regions illustrated herein, but are to include deviations in shapes that result, for example, from manufacturing.

Any and/or all elements, as disclosed herein, can be formed from a same, structurally continuous piece, such as being unitary, and/or be separately manufactured and/or connected, such as being an assembly and/or modules. Any and/or all elements, as disclosed herein, can be manufactured via any manufacturing processes, whether additive manufacturing, subtractive manufacturing and/or other any other types of manufacturing. For example, some manufacturing processes include three dimensional (3D) printing, laser cutting, computer numerical control (CNC) routing, milling, pressing, stamping, vacuum forming, hydroforming, injection molding, lithography and/or others.

Any and/or all elements, as disclosed herein, can include, whether partially and/or fully, a solid, including a metal, a mineral, a ceramic, an amorphous solid, such as glass, a glass ceramic, an organic solid, such as wood and/or a polymer, such as rubber, a composite material, a semiconductor, a nano-material, a biomaterial and/or any combinations thereof. Any and/or all elements, as disclosed herein, can include, whether partially and/or fully, a coating, including an informational coating, such as ink, an adhesive coating, a melt-adhesive coating, such as vacuum seal and/or heat seal, a release coating, such as tape liner, a low surface energy coating, an optical coating, such as for tint, color, hue, saturation, tone, shade, transparency, translucency, non-transparency, luminescence, anti-reflection and/or holographic, a photo-sensitive coating, an electronic and/or thermal property coating, such as for passivity, insulation, resistance or conduction, a magnetic coating, a water-resistant and/or waterproof coating, a scent coating and/or any combinations thereof.

Unless otherwise defined, all terms (including technical and scientific terms) used herein have the same meaning as commonly understood by one of ordinary skill in the art to which this disclosure belongs. The terms, such as those defined in commonly used dictionaries, should be interpreted as having a meaning that is consistent with their meaning in the context of the relevant art and should not be interpreted in an idealized and/or overly formal sense unless expressly so defined herein.

Furthermore, relative terms such as "below," "lower," "above," and "upper" may be used herein to describe one element's relationship to another element as illustrated in the accompanying drawings. Such relative terms are intended to encompass different orientations of illustrated technologies in addition to the orientation depicted in the accompanying drawings. For example, if a device in the accompanying drawings is turned over, then the elements described as being on the "lower" side of other elements would then be oriented on "upper" sides of the other elements. Similarly, if the device in one of the figures is turned over, elements described as "below" or "beneath" other elements would then be oriented "above" the other elements. Therefore, the example terms "below" and "lower" can, therefore, encompass both an orientation of above and below.

While various embodiments have been described above, it should be understood that they have been presented by way of example only, and not limitation. The descriptions are not intended to limit the scope of the invention to the particular forms set forth herein. To the contrary, the present descriptions are intended to cover such alternatives, modifications, and equivalents as may be included within the spirit and scope of the invention as defined by the appended claims and otherwise appreciated by one of ordinary skill in the art. Thus, the breadth and scope of a preferred embodiment should not be limited by any of the above-described exemplary embodiments.

What is claimed is:

1. A method, comprising:

allowing a first party to establish a virtual geo-fence that comprises a boundary that encompasses a geographical location;

monitoring a location of one or more devices of a plurality of devices;

determining that a second party having one or more devices of a plurality of devices is approaching the geographical location based on the monitoring;

providing a warning to the second party via the one or more devices of a plurality of devices;

transmitting the warning to the first party;

selecting an environmental safety condition for the one or more devices using the location; and selecting a device behavior for the one or more devices, the device behavior comprising a physical response produced by the one or more devices that is based on the environmental safety condition and the location.

2. The method according to claim 1, further comprising:

receiving from at least a portion of the plurality of devices, anonymized reports of emergency incidents, wherein each of the emergency incidents comprises a location;

grouping the anonymized reports into groups based on any of: the location; and user pools defined by portions of the plurality of devices that are related to one another by at least one pool attribute.

3. The method according to claim 2, further comprising:

continually reviewing the anonymized reports from the plurality of devices, and based on the continua] review:

re-selecting the environmental safety condition for at least one of the one or more devices; and re-selecting the device behavior for the at least one of the one or more devices, the device behavior comprising a vibration pattern produced by the device that is based on the environmental safety condition.

4. The method according to claim 2, further comprising generating directions or instructions that direct a user of the one or more devices along a path that avoids dangerous locations within a location that includes the environmental safety condition.

5. The method according to claim 2, further comprising receiving:

a destination for at least one device of the plurality of devices; and outputting a warning message to the at least one devices that includes an alternative destination that avoids the environmental safety condition.

6. The method according to claim 5, further comprising transmitting an alert message to one or more trusted contacts when the one or more devices enters a location that comprises the environmental safety condition, and the environmental safety condition that is indicative of danger.

7. The method according to claim 5, wherein the plurality of devices comprise a user pool and the environmental safety condition is determined by messages gathered from the user pool, wherein the environmental safety condition is a near-real time environmental safety condition.

8. The method according to claim 1, wherein a device of one or more devices of a plurality of devices includes a button.

9. The method according to claim 8, further comprising:

determining actuation of the button; and triggering recording on the device.

10. The method according to claim 8, further comprising:

determining a pattern of actuation of the button that is indicative of a perception of risk of the second party; and wherein a first type of the pattern indicates that the second party is uncomfortable or vulnerable and a second type of the pattern indicates that the second party has witness an assault or has been kidnapped.

11. The method according to claim 8, further comprising time stamping an emergency event and a location of the device.

12. The method according to claim 8, further comprising placing the device in stealth mode, wherein during stealth mode a display of the device is disabled while a camera and microphone are active.

* * * * *